US006802709B1

(12) United States Patent
Mosci

(10) Patent No.: US 6,802,709 B1
(45) Date of Patent: Oct. 12, 2004

(54) ROTARY KILN WITH A HOLLOW BRICK INSULATING LINING

(75) Inventor: Ricardo Araujo Mosci, Butler, PA (US)

(73) Assignee: Reframerica INC, Butler, PA (US)

( * ) Notice: Subject to any disclaimer, the term of this patent is extended or adjusted under 35 U.S.C. 154(b) by 0 days.

(21) Appl. No.: 10/647,164

(22) Filed: Aug. 25, 2003

(51) Int. Cl.[7] ..... F27B 7/28
(52) U.S. Cl. ..... 432/119
(58) Field of Search ..... 432/119, 248, 432/252, 264

(56) References Cited

U.S. PATENT DOCUMENTS

| | | | | | |
|---|---|---|---|---|---|
| 1,410,729 | A | | 3/1922 | Balz | |
| 1,611,373 | A | * | 12/1926 | Reagan | 52/100 |
| 1,622,431 | A | | 3/1927 | Feigenbaum | |
| 1,674,422 | A | | 6/1928 | Allen | |
| 1,688,321 | A | | 10/1928 | Abott | |
| 1,701,287 | A | | 2/1929 | Waite | |
| 2,230,141 | A | | 1/1941 | Heuer | |
| 2,230,142 | A | | 1/1941 | Longacre | |
| 2,635,865 | A | | 4/1953 | Brumbaugh | |
| 2,641,205 | A | | 6/1953 | Dolezal | |
| 3,343,824 | A | | 9/1967 | Schneider | |
| 3,528,647 | A | | 9/1970 | Hyde | |
| 3,593,970 | A | | 7/1971 | Seebold | |
| 4,289,479 | A | | 9/1981 | Johnson | |
| 4,341,514 | A | * | 7/1982 | Shanks | 432/3 |
| 4,499,134 | A | | 2/1985 | Whitely | |
| 4,582,742 | A | | 4/1986 | Gilhart | |
| 4,803,933 | A | | 2/1989 | Carey | |
| 5,033,959 | A | | 7/1991 | Bernt | |
| 5,634,313 | A | * | 6/1997 | Mogling | 52/609 |
| 5,695,329 | A | | 12/1997 | Orcutt | |
| 5,938,434 | A | * | 8/1999 | Groom | 432/241 |

* cited by examiner

*Primary Examiner*—Gregory A. Wilson
(74) *Attorney, Agent, or Firm*—Ricardo Mosei

(57) ABSTRACT

A rotary kiln for pyro-processing a variety of materials, such as cement, lime, lime sludge, clay, shale, refractory grains, bauxite, garbage and minerals, that includes a continuously-rotated, cylindrical steel shell, having a feed end for receiving material, a processing zone through which high temperature gases circulate and where the material is processed, and a discharge end where the material leaves the kiln. In addition, the feed end of the kiln being more elevated than the discharge end so as to force material flow during kiln rotation. The shell includes an inner cylindrical surface and defines a longitudinal axis extending from the feed end to the discharge end. In addition, the inner cylindrical surface includes a contiguous insulating refractory lining comprised of hollow bricks, and a work refractory lining concentric with and over the insulating lining. The linings are disposed annularly about the open processing zone. The insulating lining, comprised of hollow bricks, is intended to reduce heat flow between the work lining and the kiln shell, thus reducing kiln shell temperature.

18 Claims, 2 Drawing Sheets

ROTARY KILN WITH A HOLLOW BRICK INSULATING LINING

BACKGROUND OF THE INVENTION

1. Field of the Invention

The present invention relates to the field of rotary kilns and means of thermally insulating it. More particularly, this invention relates to a rotary kiln having a hollow-brick insulating lining between the kiln shell and the work lining, used for pyro-processing materials such as cement, lime, lime sludge, clay, shale, refractory, bauxite, garbage, ores, fuels and minerals. Such kilns normally vary in diameter between 6 and 25 ft. and in length between 200 and 600 ft., and are supported along their length by pairs of support rollers and riding rings secured to the outer surface of the shell. In U.S. Pat. No. 4,344,596, Hjaeresen provides a detailed description of the kiln mechanics. In U.S. Pat. No. 4,200,469, Touborg provides a description of how rotary kilns are fired.

Conventional insulated rotary kilns used for pyro-processing a wide variety of materials, are commonly lined with two concentric layers of refractory brick or castable. The insulating layer is installed directly on the inner surface of the shell, and the dense or work layer is installed on top and concentric with the insulating layer. The bricks in the work layer are dense and of a heat resistant refractory composition such as magnesia, dolomite, alumina, or clay, which sufficiently resist the intense heat produced in the kiln. Heat resistant refractory materials are usually good heat conductors and relatively poor heat insulators. In the rotary kiln field, one of the main problems is to contain heat within the processing zone to prevent the fast overheating and destruction of the kiln shell. Another common problem is to protect the kiln shell against permanent damage when the work lining collapses. Due to the very high temperatures maintained inside the kiln and the high thermal conductivity of the work lining, part of the thermal energy inside the kiln is lost through the work lining and the kiln shell, thus requiring that the shell be thermally insulated. Besides the heat loss, which translates into additional fuel expenditure and additional combustion gas emissions, the temperature gradient between the inside hot face and the cold face of the refractory lining develops thermo-mechanical stress within the work lining. When said stress exceeds the ultimate strength of the brick, the lining fails. Therefore, it is important to use an insulating lining between the kiln shell and the work lining.

Rotary kilns are sometimes exposed to strong winds, snowstorms and rainstorms. When the hot kiln shell is suddenly quenched, it shrinks and the refractory lining is exposed to hoop stress that can cause its rupture. For such reason it is important to insulate the inside of the kiln shell in order to reduce its outside temperature.

Several patents propose ways to insulate the inside of the rotary kiln shell, behind the work lining. The prior art normally employs two concentric layers of bricks, or two concentric layers of castable or a brick layer concentric with an insulating refractory layer. Insulating materials are normally lightweight fiber, brick or castable with thermal conductivity below 10 B.t.u./hr./sq.ft./deg. F./in. thickness. In insulated rotary kilns the typical work lining thickness varies between 6 in. and 9 in., and the typical insulating lining thickness varies between 0.25 in. and 3 in. In order to accommodate the inner kiln shell curvature the brick shapes have different tapers that, when combined in the proper ratio, can line any kiln radius. Sometimes the back up insulating brick can be either tapered or straight since it is held in place by the work lining.

2. Description of the Prior Art

Many prior art patents cover the field of rotary kiln shell insulation between the work lining and the kiln shell. Prior art for rotary kiln shell insulation comprises a wide variety of dense or work linings installed on top of fiber refractory, steel cladded fiber refractory, solid insulating brick, solid insulating castable, solid fireclay brick, solid ceramic tiles, grooved brick and tiles, brick with recesses or pockets on the outside face, and bricks with pockets on the outside face filled with fiber. For example, in U.S. Pat. No. 1,410,729 Balz invented a dense brick attached to an insulating refractory by a tongue and groove system. In U.S. Pat. No. 1,701,287 Waite invented a static furnace wall construction containing air channels behind the work lining to insulate the furnace shell. In U.S. Pat. No. 1,622,431 Feigenbaum invented an air cooled static vertical incinerator. In U.S. Pat. No. 1,674,422 Allen invented an air cooled wall. In U.S. Pat. No. 1,688,321 Ser. No. 10/23/1928 Abott invented an air cooled furnace wall. In U.S. Pat. No. 2,641,205 Dolezal invented a cooling wall for heated chambers. In U.S. Pat. No. 5,695,329 Orcutt invented a way to insulate the kiln shell with fiber material inserted between the work lining and the kiln shell. In U.S. Pat. No. 1,936,635 Lee proposed a special-shape solid brick that, when put together, creates an air gap between parts of the brick and the kiln shell. In U.S. Pat. No. 2,230,141 Heuer proposed a dense brick cemented to a solid block of insulating brick or asbestos. In U.S. Pat. No. 2,635,865 Brumbaugh invented a layer of insulating concrete anchored to the kiln shell between the work lining and the shell. In U.S. Pat. No. 3,343,824 Schneider used multiple layers of asbestos sheets as an insulator between the work lining and the kiln shell. In U.S. Pat. No. 3,528,647 Hyde employed diatomaceous earth as an insulator between the shell and the work lining of a blast furnace, a vertical, non-rotary cylindrical furnace. In U.S. Pat. No. 4,289,479 Johnson utilized solid blocks of light-weight insulating material attached to the kiln shell as insulator. In U.S. Pat. No. 4,499,134 Whitely used steel cladded fiber as an insulator behind the work lining. In U.S. Pat. No. 4,582,742 Gilhart used blocks of high-temperature fiber insulation as a back up lining in a furnace. In U.S. Pat. No. 4,803,933 Carey invented a rotary kiln brick with recessed chambers filled with insulating pads on the outside face. In U.S. Pat. No. 5,033,959 Bernt proposed cladded insulating fiber behind the work lining. In U.S. Pat. No. 5,695,329 Orcutt invented a way to insulate the rotary kiln shell with layers of reinforced insulating fiber installed behind the work lining.

The prior art of insulating rotary kilns presents some specific problems such as: asbestos is practically banned as an industrial thermal insulator because of its well-proven carcinogenic properties; ceramic fibers shrink when heated above 2000° F., causing the service lining to collapse; solid insulating and semi-insulating bricks have relatively low compressive strength, usually lower than 3,000 p.s.i.; solid insulating and semi-insulating bricks shrink when overheated, which could cause the work lining to collapse; solid fireclay or alumina brick and tile have good compressive strength and good thermal stability but their thermal conductivity is higher than insulating fiber's and insulating brick's; bricks with air gaps or pockets on the outside face help reduce heat transfer from the kiln processing zone to the shell, but they have reduced contact with the shell, a mechanical disadvantage over solid brick alternatives;

bricks with air gaps or pockets on the outside face, filled with insulating materials, help reduce heat transfer from the kiln processing zone to the shell, but these bricks have reduced contact with the shell, a mechanical disadvantage over solid brick alternatives; dual bricks, comprised of a dense brick cemented or sintered to a lightweight brick, have the disadvantage of the differential thermal expansion coefficient between the two materials. Such difference creates a shear plane within the brick that causes it to crack; forced air or convective air channels between the work lining and the shell are not applicable to rotary kilns due to their constantly turning motion and their length.

One of the main disadvantages of most prior art patents mentioned herein is the low refractoriness and the relatively low strength of the insulating lining. When the work lining fails, the insulating lining is immediately exposed to temperatures above its strength and refractoriness limit, causing it to fail. Another common problem with the prior art is the compromise between thermal conductivity and material strength. It is well known in the science of ceramics that the thermal conductivity of a porous refractory decreases with its bulk density, but so does its mechanical strength. Consequently, the more the thermal conductivity of a porous solid brick is reduced, the lower its mechanical strength. The same principle applies to dense bricks.

With this invention I have eliminated many of the disadvantages and problems of the prior art. The hollow brick is mechanically stronger than insulating brick, insulating castables, and fibers, with minimum cold compressive strength of 4,000 p.s.i. Moreover, the hollow brick is more refractory than insulating fiber, insulating castables, and insulating brick, with minimum pyrometric cone equivalent of 32.5 in the Orton scale. Unlike refractory fibers, the hollow brick can be used as a permanent lining, therefore allowing the replacement of the work lining without disturbing the insulating lining. The hollow brick material does not contain asbestos or any other hazardous substance in its composition. The hollow brick, not having recesses, grooves, or pockets on the outside face, make full contact with the kiln shell, resulting in mechanically more stable linings. The hollow brick utilizes still air, one of the best insulating substances, as insulating medium. The hollow brick allows kiln designers to change the thermal conductivity of the lining without changing its mechanical strength, refractoriness, and lining thickness, one of the major problems encountered with the prior art.

SUMMARY OF THE INVENTION

The present invention consists of a rotary kiln for pyroprocessing a wide variety of materials and includes an elongated, cylindrical steel shell through which the material transverses for processing. The kiln shell is rotated by conventional mechanical structure, well described in some of the patents referred to herein, and includes a feed end and an opposite discharge end. Furthermore, the shell includes an open processing zone extending from the feed end to the discharge end, through which the material travels and the high temperature gases circulate. The kiln shell includes an inner cylindrical surface circumjacent the open processing zone. An insulating refractory lining is disposed contiguous to the inner cylindrical surface of the shell and annularly to the longitudinal axis. The lining is comprised of adjacently independent rings of hollow bricks, held against the kiln shell by their tapered design. In another variant, the hollow bricks have no taper and are held in place by the work lining.

It is an objective of the present invention to provide a rotary kiln with an insulating refractory consisting of hollow bricks. It is another objective of the present invention to provide an insulating lining for a rotary kiln in which the insulating bricks are provided with cells or cores running parallel to the brick outside face, in the radial or axial direction, to profit from the insulating properties of still air. Still another objective of the present invention is to provide a lining for a kiln capable of supporting a layer of dense refractory material on top; without collapsing. It is yet another objective of this invention to provide an insulating lining for a rotary kiln capable of withstanding process temperatures for sufficient time to allow the kiln operator to shut the kiln down without permanent damage to the steel shell, in the event the work lining fails.

DETAILED DESCRIPTION OF THE PREFERRED EMBODIMENT

Figure 1:
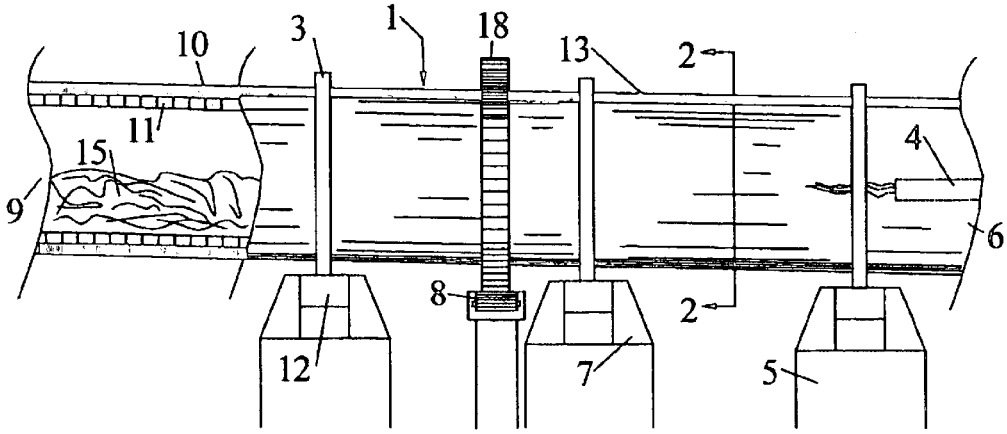
FIG. 1 is a side elevational view of an embodiment of a rotary kiln made in accordance to the present invention, partially showing the interior of the kiln.
Figure 2:
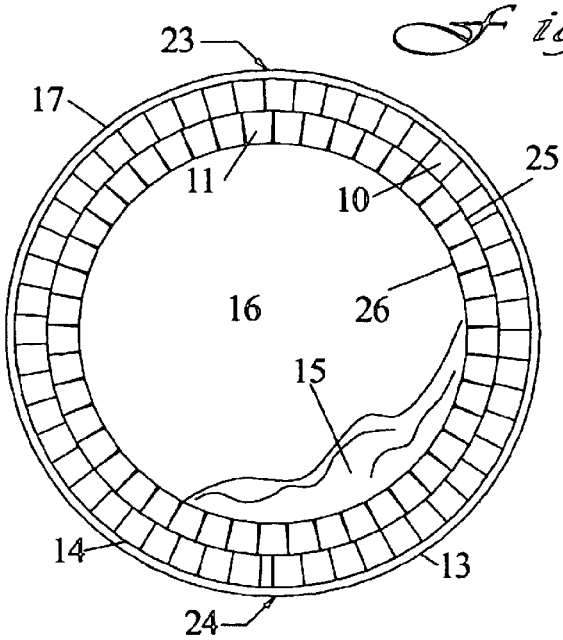
FIG. 2 is a cross-sectional view taken along lines 2—2 of FIG. 1 illustrating the kiln feed and the work lining on top of the insulating lining inside the kiln shell.

Illustrated in FIGS. 1 and 2 is a rotary kiln 1 for pyroprocessing a wide variety of materials 15 used, for example, in the agricultural, chemical, petrochemical, metallurgical, architectural brick and tile, refractory, waste-treatment, soil remediation, mineral processing, aggregate, asphalt, iron ore reduction, cement, lime, pulp and paper, and heat generating industries. Rotary kilns are essentially large, elongated furnaces that may be up to 600 ft. long, and have uniform or variable diameters between 6 and 25 ft, sloped in the longitudinal direction and turn at speeds between 0.5 and 10 revolutions per minute.

In order to protect the inner annular wall of the kiln shell 13 against deterioration and destruction by high temperatures, a work lining 11 and an insulating lining 10, as shown in FIG. 2, are annularly disposed around the inner wall adjacent an open processing zone 16 of a rotary kiln 1. The work lining 11 is in direct contact with the kiln load 15, the hot kiln gases, and the inside surface of the insulating lining 19, whereas the insulating lining 10 is in contact with the inside surface of the kiln shell 14 and the outside surface of the work lining 25.

Figure 3:
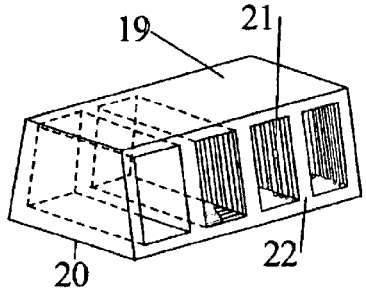
FIG. 3 is a magnified view of one brick comprising the insulating lining in FIG. 2.

FIG. 3 illustrates the main components of a typical tapered hollow brick: the solid portion 22, the open cells 21, the outside face 20 and the inside face 19. Taper is defined heretofore as the numerical dimensional difference between the width of outside face 20 and the width of inside face 19, usually known as brick chords.

The work lining 11 is normally made with alumina, fireclay, magnesia, magnesia-chrome, magnesia-zirconia, magnesia alumina-spinel, dolomite, forsterite or zirconia bricks.

Figure 4:
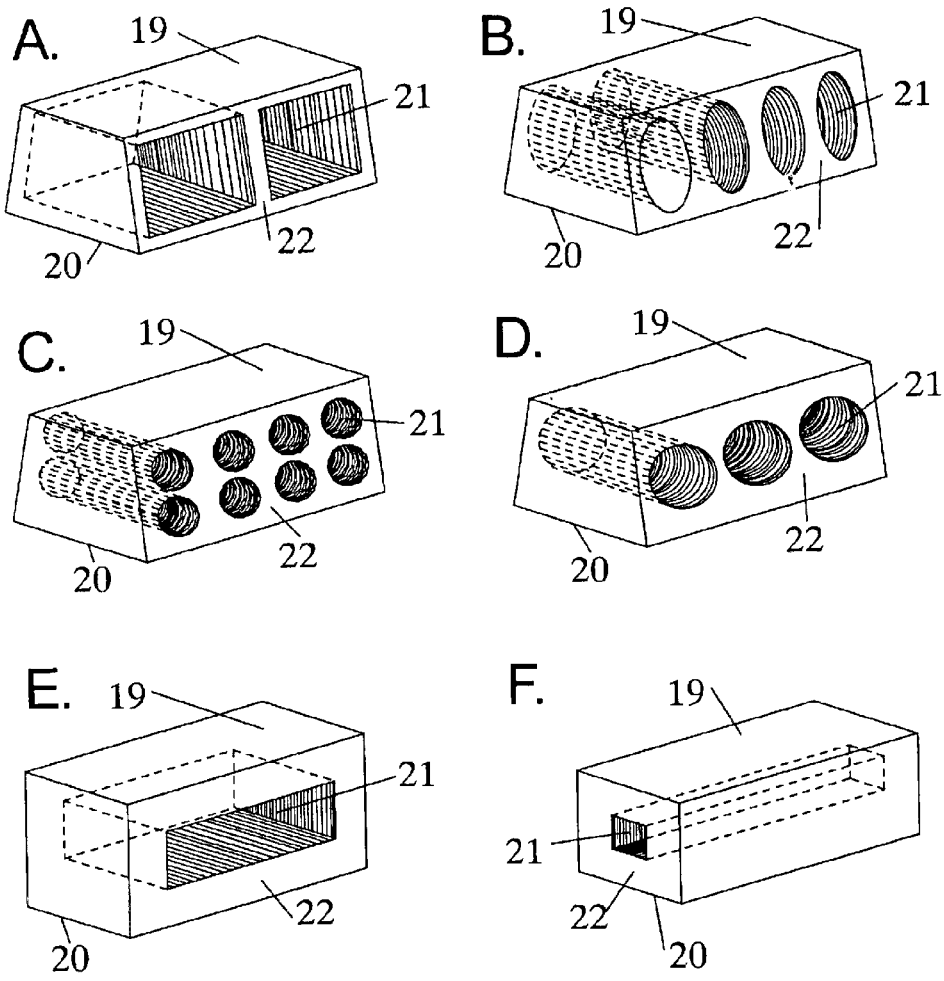
FIG. 4 is an isometric view of some types of hollow brick.

The insulating lining 10, in its preferred embodiment, is made with tapered brick as illustrated in FIGS. 4A, B, C and D, or non-tapered brick as illustrated in FIGS. 4E and F, containing holes or cells 21 to help reduce heat transfer from the work lining 11 to the kiln shell 13. Such holes or cells 21, are preferably larger than 1 in. and smaller than 9 in., and oriented parallel to the brick outside surface 20. Moreover, in a preferred embodiment, the insulating hollow bricks illustrated in FIGS. 3 and 4 are made with alumina or fireclay using any of the well-known brick manufacturing processes such as dry pressing and firing or extruding and firing. The hollow bricks A to F in FIG. 4 are preferably made using the dry-press method for better dimensional tolerances.

Shown in FIG. 1 is the rotary kiln 1 along with the structural elements to rotate the kiln 3, 12, 8 and 18, around its longitudinal axis. The kiln 1 includes an elongated, cylindrical, rotating shell 13 which has a feed end 9, an opposite discharge end 6, a burner pipe 4, and in cross-section FIG. 2 defines an open processing zone 16. The kiln 1 is erected so that the discharge end 6 is at a lower level than the feed end 9 in order to cause the material 15 being processed to move toward the discharge end 6. As the kiln load 15 is processed, it travels through the open processing zone 16 to the discharge end 6. For most kilns the discharge end 6, is in flow communication with a material cooler not shown in the drawings.

As shown in FIG. 1, the kiln shell 13 is supported by riding rings or tires 3 that engage steel rollers 12 which are supported on concrete piers 5 and steel frames 7. In operation the kiln 1 is driven by a motor reducer (not shown) connected to a pinion 8 and to the kiln main gear 18. The mechanical structure for rotary kilns, and also their feeding and firing systems, are well known to the conventional art and need not be described here. For a detailed description of the operation methods see U.S. Pat. Nos. 4,200,469 and 4,344,596.

As illustrated in FIGS. 1 and 2, the kiln shell 13 includes an outer annular surface 17 and an opposite inner cylindrical surface 14. Both surfaces 17 and 14 extend from the feed end 9 to the discharge end 6. In addition, the elongated shell 13 defines an imaginary longitudinal axis which also extends from the feed end 9 to the discharge end 6 and around which the kiln 1 circumjacently rotates. An insulating lining 10 is disposed within the shell 13 and is secured contiguous to the inner shell surface 14. A work lining 11 is disposed within and concentrically to the insulating lining 10 to protect the insulating lining 10 from the hot gases and the hot kiln load 15. The insulating lining 10 is comprised of multiple rings of hollow brick illustrated in FIGS. 3 and 4, containing cells or holes 21 naturally filled with air. As shown in FIG. 4, the holes or cells 21 inside the hollow brick can have different shapes, sizes and directions, such as A, B, C, D, E, and F. As also shown in FIG. 4, the hollow brick can be tapered as in A, B, C, D, or straight as in E and F. As shown in FIGS. 4E and F, the cells 21, parallel to the outside face 20, can be oriented in the circumferential or in the axial direction.

As shown in FIGS. 1 through 4, in the preferred embodiment, an insulating hollow brick lining 10 having internal cells 21 of rectangular shape, a plurality of which are annularly secured to the inner shell surface 14 in such a way as to form complete rings. Therefore, a series of these hollow bricks are secured against the inner surface of the kiln shell 14 by means of their tapered shape. Each hollow brick includes an outside face 20 which is disposed contiguous to the inner shell surface 14, a major body portion 22, open cells or cores 21, an inside face 19 in contact with the outside face 25 of the work lining 11.

As shown in FIG. 2, in the preferred embodiment, a dense work lining 11, formed by tapered brick, a plurality of which are annularly arranged around and against the inside face 19 of the insulating lining 10, in such a way as to form complete rings. Therefore, a series of these brick 11 are secured against the insulating lining 10 by means of their tapered shape. Each dense brick of the work lining 11 includes an outside face 25 which is disposed contiguous to the inner insulating lining surface 19, a major body portion protruding towards the kiln imaginary axis and an inside face 26 that comes in direct contact with the kiln gases and the kiln load 15.

During installation, in order to secure the bricks of linings 10 and 11 to surfaces 14 and 25 respectively, so as to complete the concentric brick rings, jacks, pogo sticks, metal or wooden bricking rigs temporarily compress the bricks against the shell inner surface 14 or the previous brick layer surface 25, until the shell circumference is completed and the key-brick is inserted and tightened.

Typically the bricking of the rotary kiln commences at the lowest point of the kiln shell 24, and then extends upward in both clockwise and counterclockwise direction to the top-most point 23 of the shell 13. The insulating lining 10 and the work lining 11 can be installed either simultaneously or one at a time when using tapered brick as the insulating liner. The insulating lining 10 and the work lining 11 must be installed simultaneously, when using straight brick as the insulating liner.

In the preferred embodiment, the insulating lining 10 is formed by a combination of two bricks with different tapers, so that by combining the bricks in different ratios, any kiln diameter between 6 ft. and 23 ft. can be lined. The preferred hollow brick dimensions are 9 in. long by 3 in. tall, with 3 pockets or holes 21 measuring 1.5 in. high by 3.5 in. wide. One brick shape tapers from 3 in. on its outside chord to 2.75 in. on its inside chord, and the other brick shape tapers from 3 in. on the outside chord to 2.95 in. on its inside chord. The work lining 11 is usually comprised of standard tapered arch or wedge shaped bricks which are well described in most refractory manufacturers technical manuals, and installed in a similar way described for the insulating lining.

The foregoing is considered as illustrative only of the principles of the invention. Further, since numerous modifications and changes will readily occur to those skilled in the art, it is not desired to limit the invention to the exact construction and operation shown and described. For example, as illustrated in FIG. 4, the orientation, distribution and size of the cells inside the hollow-brick can be modified; the cavities can be filled with ceramic fiber or other insulating material; the brick shape can be changed from tapered to straight; a layer of insulating material can be installed above or below the hollow-brick lining. None of these modifications defeat the main idea of this invention, which is the use of hollow-bricks as a back up thermal insulation for rotary kilns. Accordingly, all suitable modification and equivalents may be resorted to fall within the scope of the invention.

What I claim as my invention is:

1. A rotary kiln for pyro-processing organic and inorganic materials, comprising:

a cylindrical, elongated steel shell having a feed end, an opposite discharge end, the feed end being more elevated than the discharge end, and defining an interior longitudinal heating chamber for pyro-processing materials; a driving mechanism to rotate the kiln around its longitudinal axis to maintain the material therein moving from the feed end to the discharge end; an insulating refractory lining contiguous to the cylindrical shell, comprised of a plurality of hollow refractory brick, in abutment with respect to one another, as means to contain heat; a work refractory lining, annularly contiguous to said insulating lining, comprised of a plurality of refractory brick members, in abutment with respect to one another, as means to contain heat and support the material under processing.

2. A rotary kiln construction as set forth in claim 1 wherein said insulating refractory lining is built with hollow bricks.

3. The kiln of claim 2 wherein the work lining is comprised of dense brick.

4. The kiln of claim 3 in which the insulating lining includes a plurality of bricks secured to the inner cylindrical surface of the shell in both axial and circumferential directions.

5. The kiln of claim 4 wherein the insulating hollow-bricks are composed of a refractory material.

6. The kiln of claim 5 where the hollow-bricks are tapered or straight.

7. The kiln of claim 6 wherein the hollow-bricks are made by pressing and firing.

8. The kiln of claim 7 in which the insulating lining thickness is between 1.5 in. and 4 in.

9. The kiln of claim 8 wherein the insulating brick outside chord measurement is between 2 in. and 4 in.

10. The kiln of claim 9 where the insulating brick inside chord measurement is between 1 in. and 3.9 in.

11. The kiln of claim 10 in which the insulating brick length is between 6 in. and 12 in.

12. The kiln of claim 11 wherein the dense work lining includes a plurality of bricks secured to the inner cylindrical surface of the insulating lining in the axial and circumferential directions.

13. The kiln of claim 12 in which the dense bricks are composed of a refractory material.

14. The kiln of claim 13 wherein the work lining bricks are tapered.

15. The kiln of claim 14 wherein the brick lining thickness is between 6 in. and 10 in.

16. The kiln of claim 15 where the brick outside chord measurement is between 2 in. and 9 in.

17. The kiln of claim 16 in which the dense brick inside chord measurement lies between 1 in. and 8.9 in.

18. The kiln of claim 17 in which the work brick length is between 6 in. and 12 in.

* * * * *